United States Patent [19]

Matsuo

[11] Patent Number: 5,052,671

[45] Date of Patent: Oct. 1, 1991

[54] FEEDING DEVICE

[75] Inventor: Toshihisa Matsuo, Yamatokoriyama, Japan

[73] Assignee: Sharp Kabushiki Kaisha, Osaka, Japan

[21] Appl. No.: 511,172

[22] Filed: Apr. 19, 1990

[30] Foreign Application Priority Data

May 9, 1989 [JP] Japan ..... 1-116436

[51] Int. Cl.[5] ..... B65H 3/44

[52] U.S. Cl. ..... 271/9; 271/164; 271/241; 226/110

[58] Field of Search ..... 271/9, 241, 162, 164; 226/110

[56] References Cited

U.S. PATENT DOCUMENTS 4,763,889 8/1988 Dei ..... 271/9
4,786,042 11/1988 Stemmle ..... 271/9

FOREIGN PATENT DOCUMENTS 56-59245 5/1981 Japan .
59-123859 7/1984 Japan .

*Primary Examiner*—Richard A. Schacher

[57] ABSTRACT

A feeding device comprises lateral and longitudinal feed position sensors for detecting that a rotatable cassette is placed in lateral or longitudinal feed positions, respectively, and a control device for controlling a cassette rotating motor based on the input from the lateral feed position sensor or the longitudinal feed position sensor, such that the longitudinal or lateral feed positions of the rotatable cassette and a fixed cassette differ. Accordingly, a situation can be avoided where the rotatable cassette and the fixed cassette that contain copy paper sheets of the same size are placed in the same longitudinal or lateral feed direction. The time can therefore be shortened for feeding the required amount of copy paper sheets in the apparatus to which the feeding device is attached. In addition, a rotation prohibition input device can be provided for inputting to the control device an instruction prohibiting the rotation of the rotatable cassette. The device is arranged such that the control device cancels the control to the cassette rotating motor in response to input from the rotation prohibition input device. Consequently, the time needed for feeding the required amount of copy paper sheets may be shortened. In addition, when the rotatable cassette and the fixed cassette contain copy paper sheets of the same size and are placed in the same longitudinal or lateral feed direction, a large amount of copy paper sheets can be supplied continuously when necessary.

23 Claims, 9 Drawing Sheets

FEEDING DEVICE

FIELD OF THE INVENTION

The present invention relates to a feeding device used in copying machines, printers, over-head projectors and other apparatuses.

BACKGROUND OF THE INVENTION

In the conventional art, for example in a copying machine, there is installed a paper feeding device that supplies copy paper, and that is provided with a plurality of paper feeding cassettes for each copy paper size. For conveying the copy paper from the paper feeding device, lateral feed where the transport direction coincides with the crosswise direction of the copy paper, is preferred in terms of transport time to longitudinal feed where the transport direction coincides with the lengthwise direction of the copy paper. Some copying machines even feed laterally copy paper sheets of B4 and A3 sizes.

However, feeding large size copy paper laterally causes the photoreceptor drum, the transport rollers, the transport path of the paper, and other parts inside the copying machine to become large. As a result the copying machine itself becomes large and bulky, and its cost rises. Hence generally, the method of feeding longitudinally copy paper of a large size such as A3 or B4, and feeding laterally copy paper of a size smaller than A4, is adopted.

However, with such an arrangement, in a copying machine provided with a variable magnification function that performs reductions and enlargements, for instance B5R and A4R paper feeding cassettes that feed the copy paper longitudinally are necessary to perform reduced copying. In addition, when thinking of transport time, A4 and B5 paper feeding cassettes that feed the copy paper laterally, are also necessary. Accordingly, when it comes to installing those different types of paper feeding cassettes, either the paper feeding device has to be designed in a large size, or the paper feeding cassettes must be changed as occasion calls. This causes the size of the copying machine to be large and its cost to rise, or the operation of the copying machine to become complicated.

Hence, in order to avoid such a problem, an arrangement is suggested as disclosed in the Japanese Publication for Unexamined Patent Application No. 59245/1981 and No. 123859/1984, (Tokukaisho No. 56-59245 and Tokukaisho No. 59-123859). Namely, a common paper feeding cassette is used both as B5 paper feeding cassette and B5R paper feeding cassette, and a common paper feeding cassette is used both as A4 paper feeding cassette and A4R paper feeding cassette. The copy paper is fed laterally or longitudinally by rotating the paper feeding cassettes.

However, with the above conventional arrangement, when copy paper of the same size is stored in a rotatable cassette that is capable of rotating to a longitudinal feed position to feed the copy paper longitudinally, or to a lateral feed position to feed the copy paper laterally, and in a fixed cassette that is fixed in either longitudinal feed position or lateral feed position, how to set the relationship between the feed positions of both cassettes has not been taken into consideration. As a result, the above conventional arrangement suffers from the drawback that the time needed for feeding the required amount of copy paper sheets in the copying machine is not satisfactory yet.

SUMMARY OF THE INVENTION

An object of the present invention is to assure a rapid supply of copy materials, by positioning cassettes containing copy materials of the same size in different feed positions.

Another object of the present invention is to supply a large amount of copy materials of the same size that cannot be stored in a single cassette, in the same continuous feed direction.

In order to achieve the objects mentioned above, a feeding device in accordance with the present invention comprises:

position detecting means for detecting at least two feed positions, and control means for controlling driving means based on the input coming from the position detecting means so that, when copy materials of the same size are stored in a fixed holding member wherein copy materials can be stored as well as in a movable copy material orientation changing means, the feed positions of the movable copy material orientation changing means and of the fixed holding member, differ.

With the above arrangement, information concerning the size of the copy materials stored in the copy material orientation changing means, the size of the copy materials stored in the fixed holding member, and the feed position of the fixed holding member, are entered in the control means. The control means controls the driving means so that, when copy materials of the same size are stored in the copy material orientation changing means and the fixed holding member, the feed positions of the copy material orientation changing means and the fixed holding member differ. For example, suppose the fixed holding member is in the lateral feed position, the driving means is controlled whereby the copy material orientation changing means is moved so as to be placed in the longitudinal feed position. The feed position, longitudinal or lateral, of the copy material orientation changing means can be found out through the input coming from the position detecting means.

Accordingly, a situation where the copy material orientation changing means and the fixed holding member are placed in the same feed position when both contain copy materials of the same size, can be avoided. For example, when copy materials of the same A4 size are stored in the copy material orientation changing means and the fixed holding member, the copy material orientation changing means is moved to the A4R position. As a result, even when either the A4 feed position or the A4R feed position is selected as a feed position for supply of the copy materials, the supply of copy materials can be executed rapidly, with no need to perform the operation of moving the copy material orientation changing means and first placing it in the corresponding feed position first.

In order to achieve the above objects, another feeding device in accordance with the present invention further comprises a motion prohibition input means for inputting to the control means an instruction prohibiting the motion of the copy material orientation changing means.

With the above arrangement, the control means as well as being able to perform the operation described earlier, is able to cancel the above control to the driving means in response to the input coming from the motion prohibition input means. By executing the control in such a manner, the supply of copy materials can be performed rapidly, and in addition, for example, when the copy material orientation changing means and the fixed holding member contain copy materials of the same size and are placed in the same feed position, copy materials of the same size can be supplied in the same feed direction in a number exceeding the number of copy materials that& can be stored in the copy material orientation changing means or in the fixed holding means, when necessary. In other words, a large amount of copy materials can be continuously supplied in the same direction.

For a fuller understanding of the nature and advantages of the invention, reference should be made to the ensuing detailed description taken in conjunction with the accompanying drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

FIG. 1 to FIG. 8 illustrate an embodiment of the present invention and are given by way of illustration only, and thus are not limitative of the present invention, and wherein:

FIG. 1(*a*) is a flowchart illustrating the control operation of a main body microcomputer shown in FIG. 7;

FIG. 1(*b*) is a flowchart illustrating the control operation of a desk microcomputer shown in FIG. 7;

FIG. 2 is a diagram illustrating the entire configuration of a copying machine provided with a paper feeding device;

FIG. 3 is a perspective view illustrating a situation where a second rotatable cassette unit shown in FIG. 2, is drawn out;

FIG. 4(*a*) is a partial cross-sectional perspective view illustrating the first and second rotatable cassette units shown in FIG. 2;

FIG. 4(*b*) is an enlarged perspective view illustrating the vicinity of a nut shown in FIG. 4(*a*);

FIG. 5 is a perspective view illustrating the main part of a cassette mounting unit provided in a main body and a desk of the copying machine and a projecting member provided in each fixed cassette;

FIG. 6(*a*) is a front view illustrating an operation panel;

FIG. 6(*b*) is a front view illustrating a cassette operation unit of the operation panel;

FIG. 7 is a block diagram illustrating a control unit;

FIG. 8 is a view illustrating the rotating process of a rotatable cassette.

DESCRIPTION OF THE EMBODIMENTS

An embodiment of the present invention will be described with reference to FIG. 1 to FIG. 8.

Figure 2:
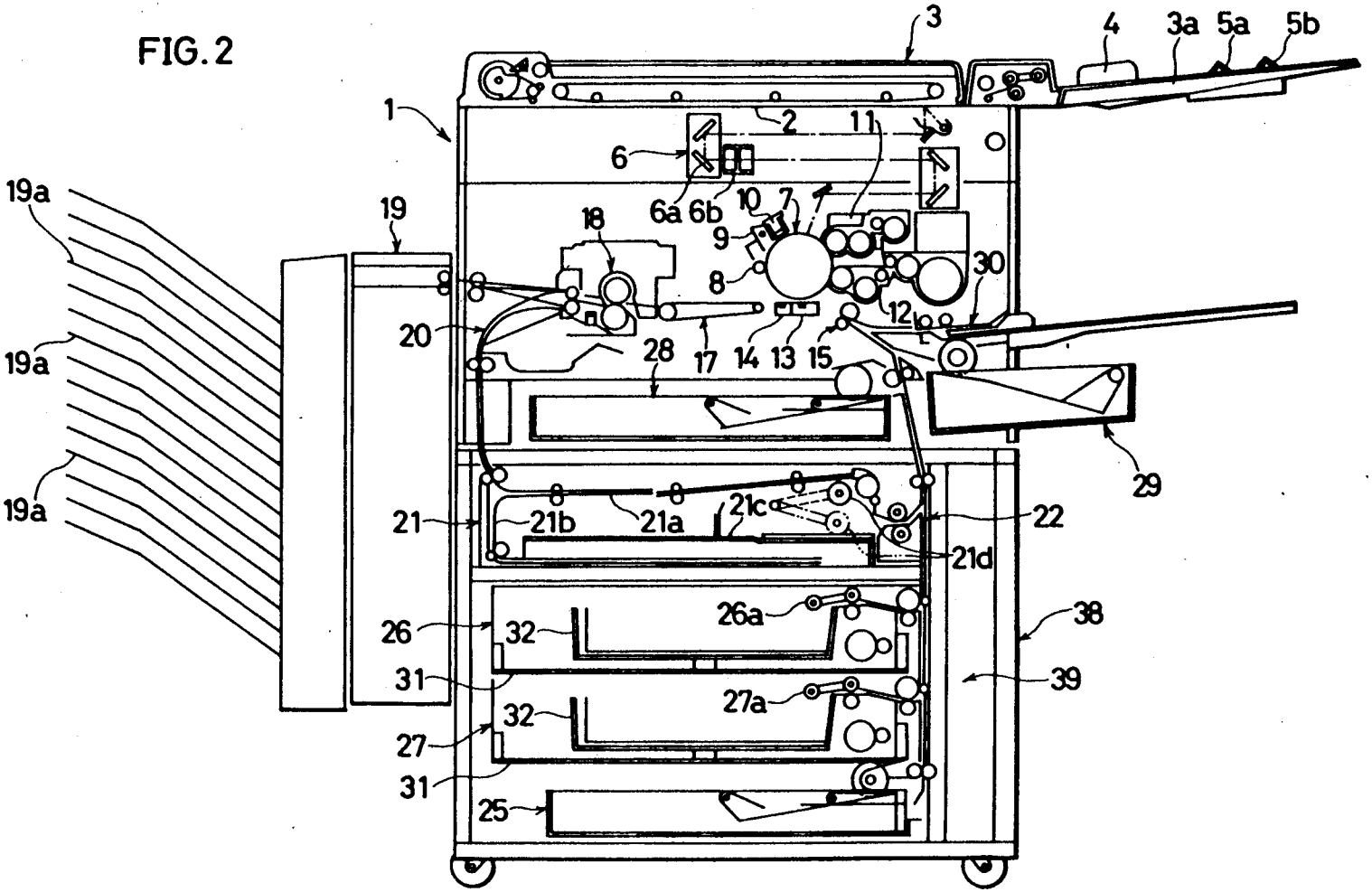
Figure 3:
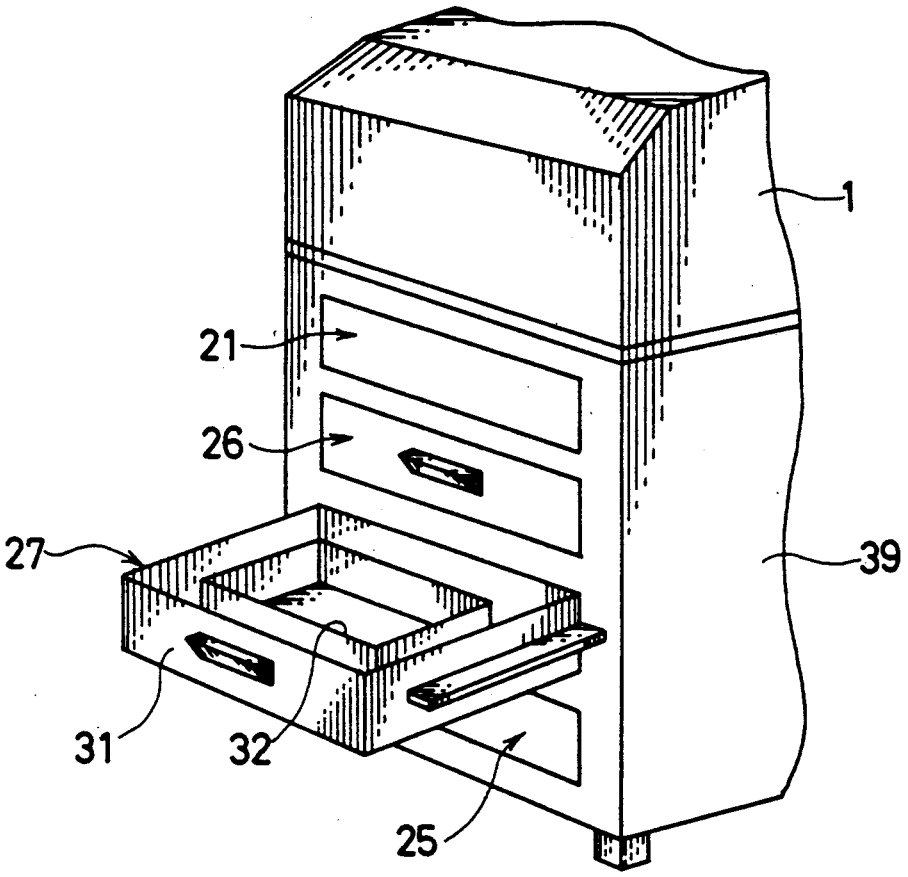

As illustrated in FIG. 2, a copying machine includes a desk 38 installed under a copying machine main body 1, a sorter 19 mounted on the paper discharging side of the copying machine main body and an automatic document feeder 3 (hereinbelow referred to as ADF) mounted above the copying machine main body 1. In the desk 38, there are installed, from the top on, a duplex/composite unit 21, a first rotatable cassette unit 26, a second rotatable cassette unit 27, and a third fixed cassette 25, as illustrated in FIG. 3. The first and second rotatable cassette units 26 and 27 are each provided with a rotatable cassette 32 (copy material orientation changing means), that is capable of rotating. The cassette 32 is mounted inside an outer box 31 (accommodating member).

The ADF 3 is mounted above a document glass plate 2 of the copying machine main body The ADF 3 has a function for transporting a document not shown that was placed on a document tray 3*a*, to a predetermined position on the document glass plate 2 in accordance with the size and with the longitudinal or lateral feed direction of the document, and for discharging the document once copying is completed. Further, the ADF 3 is also provided with a function for turning the document over, for example when copying both sides of the document, and for transporting it again to the predetermined position on the document glass plate 2, and discharging it after both sides are copied.

On the document tray 3*a*, there are installed transport direction detection switches 5*a* and 5*b* that detect the transport direction dimension of the document, and a guide 4 that regulates the crosswise direction sides of the document. The guide 4 is provided with crosswise direction detection switches, not shown, that detect the crosswise direction dimension of the document.

Below the document glass plate 2, there is placed an optical system 6 composed of a plurality of reflecting mirrors 6*a* and a plurality of lenses 6*b*. In addition to a basic function for leading the optical image of the document to the photoreceptor drum 7, the optical system 6 also has a magnification function that permits full size copying, as well as enlarged and reduced copying.

In the periphery of the photoreceptor drum 7, there are placed a cleaner 8, a static eliminating charger 9, a electrostatic charger 10, a developing device 11 provided with toner for color copying, and a developing device 12 provided with black toner. The following sequence of operations is performed by the above means and the optical system 6 described earlier: electrostatic charge of the photoreceptor drum 7, exposure, development, removal of the remaining toner, and static elimination.

Below the photoreceptor drum 7, there are installed a transfer charger 13 and a separating charger !4. A toner image on the photoreceptor drum 7 is transferred on copy paper (copy material) that was supplied to the photoreceptor drum 7 by means of the transfer charger 13, and the copy paper is separated from the photoreceptor drum 7 by means of the separating charger 14. The copy paper is conveyed by a transport belt 17 to a fixing device 18 where the toner image on the copy paper is fixed by heat and pressure.

Basically, after it passed through the fixing device 18, the copy paper goes through a sorter 19 and is discharged on a discharge tray 19*a* of the sorter 19. However, for example during the duplex or composite copying, the copy paper passes through a paper returning path 20 and is led to the duplex/composite unit 21 inside the desk 38. During the duplex copying, the copy paper passes through a first transport path 21*a* inside the duplex/composite unit 21, is turned over and placed on an intermediate tray 21*c*, and is sent by a delivery roller 21*d* to a paper feed transport path 22. On the other hand, during composite copying, the copy paper is sent to a second transport path 21*b* inside the duplex/composite unit 21, where the trailing edge of the copy paper is detected and the copy paper conveyed in the reversed direction. The copy paper passes through the first transport path 21a and is turned over and placed on the intermediate tray 21c. The copy paper is then sent to the paper feed transport path 22 by the delivery roller 21d.

The paper feed transport path 22 extends up to the proximity of the photoreceptor drum 7. At the end of the paper feed transport path 22, there is installed a paper stopping roller 15 for synchronizing the transport of the copy paper and the rotation of the photoreceptor drum 7. In the paper feed transport path 22, a plurality of paper feeding means are juxtaposed, and provision is made such that the copy paper is properly fed from these paper feeding means. Concretely, there are installed in order from the paper feeding means which paper transport path for conveying the copy paper to the paper stopping roller is the shortest: a manual paper feeder 30, a first fixed cassette 29 (fixed holding member) having a storage capacity of 500 sheets, a second fixed cassette 28 (fixed holding member) having a storage capacity of 250 sheets, the duplex/composite unit 21, the first rotatable cassette unit 26, the second rotatable cassette unit 27, and the third fixed cassette unit 25 (fixed holding member) having a storage capacity of 250 sheets.

The cassettes group of a paper feeding device 39, as a feeding device, is composed by the first fixed cassette 29 and the second fixed cassette 28, both installed in the copying machine main body 1, and the duplex/composite unit 21, the first rotatable cassette unit 26, the second rotatable cassette unit 27 and the third fixed cassette 25, all installed in the desk 38. The fixed cassettes 29, 28 and 25, and the rotatable cassette units 26 and 27 are all detachable from the copying machine.

Figure 4A:
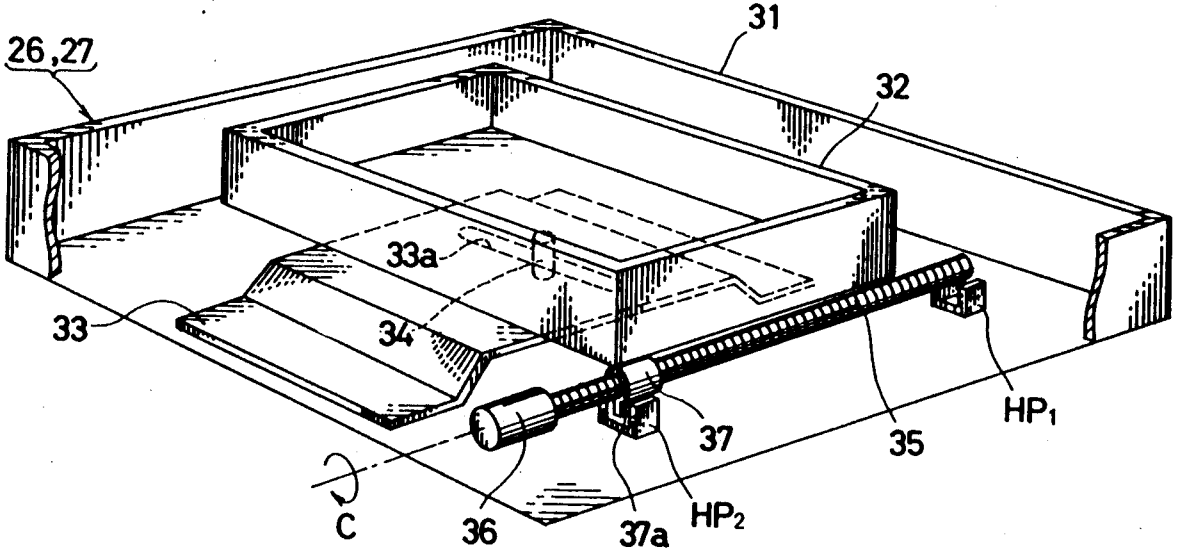
Figure 4B:
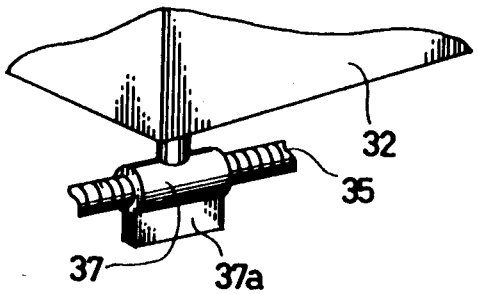

As illustrated in FIG. 4(*a*), the first and second rotatable cassette units 26 and 27, are each provided with an outer box 31, and a rotatable cassette 32 (copy material orientation changing means) installed in the outer box 31, for storing copy paper sheets of a predetermined size. The rotatable cassette 32 is provided with a rotating plate (not shown) for raising the copy paper inside the rotatable cassette 32 according to the decrease in the amount of copy paper. On the bottom wall of the outer box 31, there is mounted a cassette support plate 33 (supporting member), which central portion is separated from the bottom wall of the outer box 31. In the central portion of the cassette support plate 33, there is formed a guide hole 33a in the shape of a long hole in the paper feed direction. In the central portion on the external face of the rotatable cassette 32, a guide shaft 34 (guiding member) that is set in the guide hole 33a, is mounted so as to project downwards.

A threaded shaft 35 is mounted in the outer box 31 so as to be orthogonal to the paper feed direction of the rotatable cassette 32, and parallel with the bottom wall of the outer box 31. The threaded shaft 35 is supported by a bearing, not shown, so as to rotate freely. As one of its edges is connected to the rotation shaft of a cassette rotating motor 36 (driving means), the threaded shaft 35 is capable of rotating clockwise and counterclockwise. A nut 37 moves back and forth in the shaft direction according to the clockwise or counterclockwise rotation of the threaded shaft 35. This nut 37 is fitted on the threaded shaft 35. As illustrated in FIG. 4(*b*), the upper edge of the nut 37 is pivotally connected to a corner of the rotatable cassette 32. A light interrupting plate 37a is formed in the lower part of the nut 37.

Meanwhile, a lateral feed position sensor $HP_1$ (position detecting means), and a longitudinal feed position sensor $HP_2$ (position detecting means) that are each composed by a photointerruptor provided with a light emitting element and a light receiving element, are installed below the threaded shaft 35 in proximity of the edges thereof. The lateral feed position sensor $HP_1$ detects that the rotatable cassette 32 was rotated and moved to the predetermined lateral feed position, and the longitudinal feed position sensor $HP_2$ detects that the rotatable cassette 32 has moved to the predetermined longitudinal feed position. When the rotatable cassette 32 moves to the predetermined lateral feed position or longitudinal feed position, the light interrupting plate 37a interrupts the light going from the light emitting element to the light receiving element (at this time the position sensors $HP_1$ and $HP_2$ turn ON). Consequently, the positions sensors $HP_1$ and $HP_2$ detect that the rotatable cassette 32 has moved to the predetermined position. Moreover, the position sensors $HP_1$ and $HP_2$ do not have to be necessarily photointerruptors, but may be magnetic sensors, contact type switches, or the like.

Figure 5:
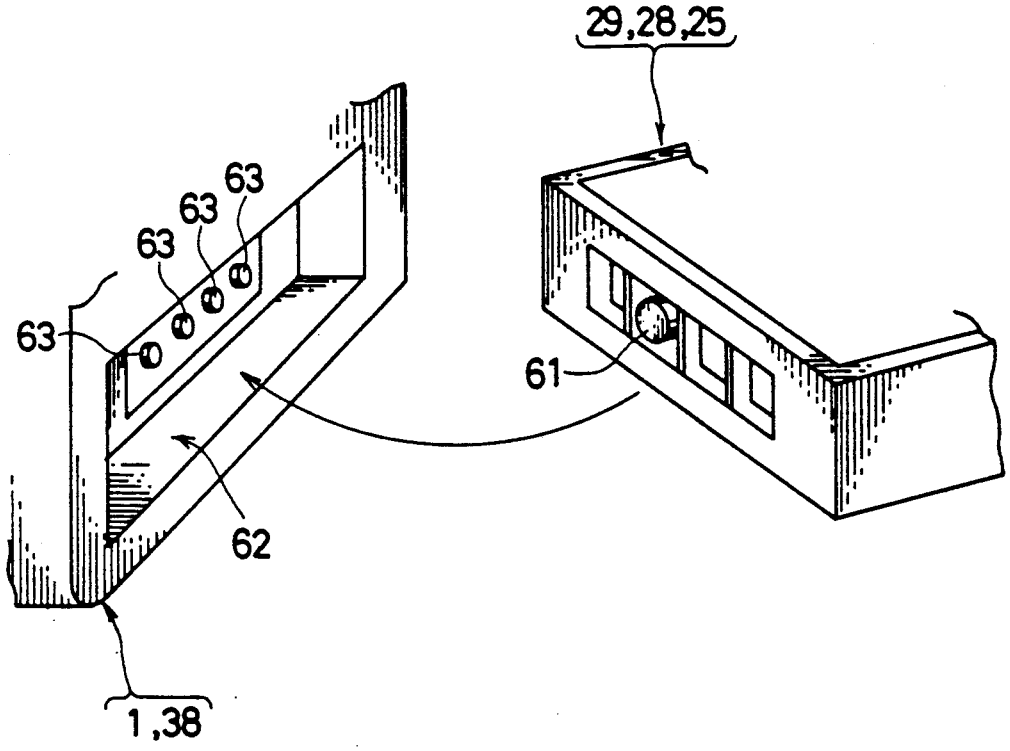

As illustrated in FIG. 5, projecting members 61 are mounted on the first fixed cassette 29 and the second fixed cassette 28 that are located in the copying machine main body 1, and the third fixed cassette of the desk 38. Each projecting member 61 is placed in a position corresponding to the size of the copy paper stored in the fixed cassette 29, 28 or 25. Meanwhile, on cassette mounting units 62 located in the copying machine main body 1 and the desk 38, there are installed a plurality of paper size detection switches 63 that are turned on by the above projecting members 61. In the present embodiment, there are provided for example four paper size detection switches 63 corresponding to the A3, B4, A4 and B5 sizes. The paper size detection switches 63 located on the copying machine main body 1, are connected to a main body microcomputer 64 (main processing unit) to be described later, and the paper size detection switches 63 located on the desk 38 are connected to a desk microcomputer 51 (sub-processing unit) . With such an arrangement, when the fixed cassettes 29, 28 and 25 are installed in the copying machine main body 1 or the desk 38, the main body microcomputer 64 and the desk microcomputer 51 are able to know the size and the feed direction of the copy paper stored in the fixed cassettes 29, 28 and 25. As to the sizes of the copy paper stored in the rotatable cassettes, they are entered in the desk microcomputer 51 by means of an arrangement similar to the arrangement described above, or other input means.

Figure 6:
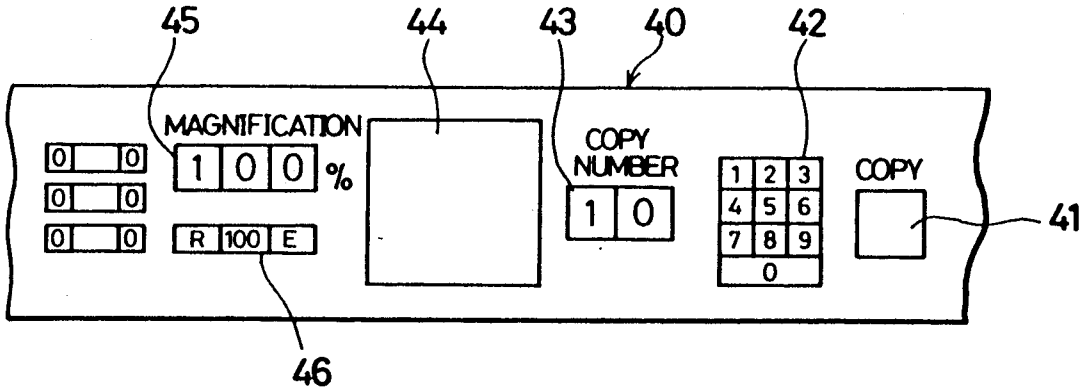
Figure 6:
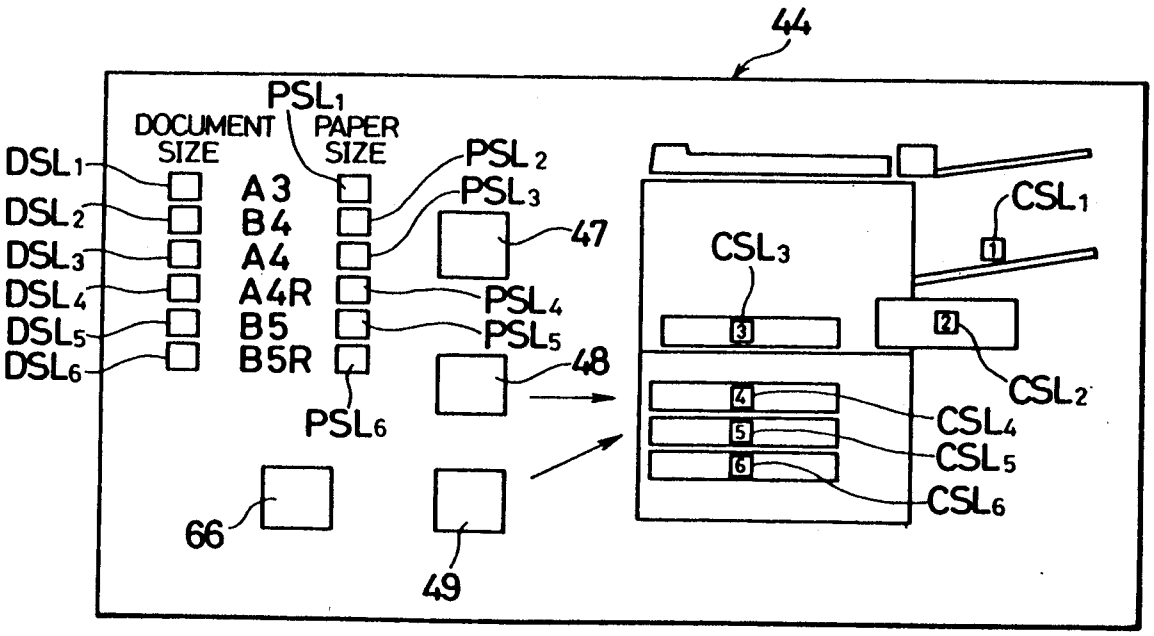

The copying machine main body 1 is provided on its top surface with an operation panel 40 shown in FIG. 6(*a*). The operation panel 40 is provided with a copy button 41 for instructing the start of the copying operation, ten keys 42 for setting the number of copies to be made and the like, a copy number display 43, a cassette operation unit 44, a magnification display 45, and magnification setting keys 46, etc.

As illustrated in FIG. 6(*b*), the cassette operation unit 44 is provided with a rotation prohibition input key 66 as rotation prohibition means to be used for instructing the rotation prohibition of the rotatable cassette 32 installed in the first rotatable cassette unit 26 or the rotatable cassette 32 installed in the second rotatable cassette unit 27, a cassette change over key 47 for selecting a cassette, a cassette rotation key 48 for instructing the rotation of the rotatable cassette 32 installed in the first rotatable cassette unit 26, a cassette rotation key 49 for instructing the rotation of the rotatable cassette 32 installed in the second rotatable cassette unit 27, and other keys. The cassette operation unit 44 is further provided with document size display lamps $DSL_1$ to $DSL_2$, paper size display lamps $PSL_1$ to $PSL_6$, and cassette selection display lamps $CSL_1$ to $CLS_6$ that display numbers from 1 to 6 respectively corresponding in order to the manual paper feeder 30, the first fixed cassette 29, the second fixed cassette 28, the first rotatable cassette unit 26, the second rotatable cassette unit 27 and the third fixed cassette unit 25. In addition, provision is made such that when copy paper is not loaded in one of the rotatable cassette units 26 and 27, one of fixed cassettes 25, 28 and 29 or the manual paper feeder 30, the corresponding lamp among the paper size display lamps $PSL_1$ to $PSL_6$ does not light up.

Figure 7:
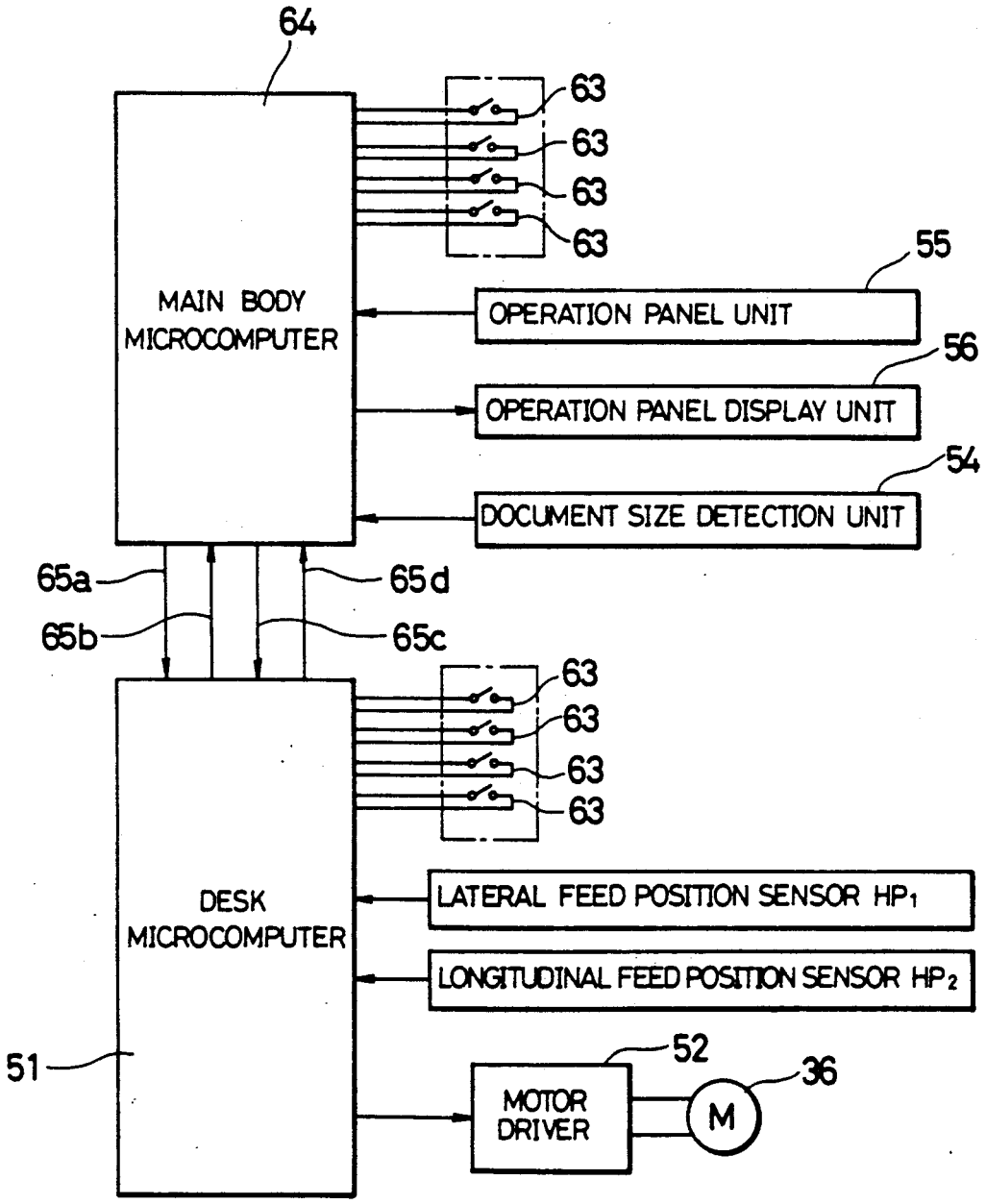

As illustrated in FIG. 7, the copying machine is provided with the main body microcomputer 64 installed on the copying machine main body 1, and the desk microcomputer 51 installed on the desk 38. The main body microcomputer 64 and the desk microcomputer 51 constitute the control means of the paper feeding device 39.

The main body microcomputer 64 and the desk microcomputer 51 are connected with each other by four communication channels 65*a* to 65*d*. The communication channel 65*a* is a serial communication channel for transmitting data from the main body microcomputer 64 to the desk microcomputer 51. The communication channel 65*b* is a serial communication channel for transmitting data from the desk microcomputer 51 to the main body microcomputer 64. The communication channel 65*c* is a channel indicating whether the main body microcomputer 64 is ready to send or receive data. And the communication channel 65*d* is a channel indicating whether the desk microcomputer 51 is ready to send or receive data.

For instance, when the communication channel 65*c* is in the high level, this indicates that the main body microcomputer 64 is ready to receive data. Namely, when the desk microcomputer 51 detects that the communication channel 65*c* is in the high level, the communication from the desk microcomputer 51 to the main body microcomputer 64 is performed through the communication channel 65*b*.

Similarly, when the communication channel 65*d* is in the high level, this indicates that the desk microcomputer 51 is ready to receive data. Namely, when the main body microcomputer 64 detects that the communication channel 65*d* is in the high level, the communication from the main body microcomputer 64 to the desk microcomputer 51 is performed through the communication channel 65*a*.

Also provision is made such that either of the communications cannot be performed when communication channels 65*c* and 65*d* are both in the low level.

With the arrangement described above, the main body microcomputer 64 can know the size of the copy paper stored in the rotatable cassettes 32 of the first and second rotatable cassette units 26 and 27, and the third fixed cassette 25 that are installed in the desk 38, whether the rotatable cassettes 32 are in the longitudinal or lateral feed position, as well as other data concerning the state of the desk 38.

As described earlier, the main body microcomputer is connected with the paper size detection switches 63 corresponding to the first fixed cassette 29 and the second fixed cassette 28. Further, a document size detection unit 54, operation panel unit 55, and an operation panel display unit 56 are respectively connected to the main body microcomputer 64.

The document size detection unit 54 is composed of the crosswise direction detection switches not shown, that are mounted on the guide 4 of the document tray 3*a*, and the transport direction detection switches 5*a* and 5*b*. Based on the condition of the above detection switches, the document size detection unit 54 supplies four bit data to the desk microcomputer 51 via the main body microcomputer 64.

The operation panel unit 55 comprises the rotation prohibition input key 66, the copy button 41, the ten keys 42, the magnification setting keys 46, the cassette change over key 47 and the cassette rotation keys 48 and 49, that are installed on the operation panel 40 of the copying machine main body 1.

The operation panel display unit 56 comprises the copy number display 43, the magnification display 45, the document size display lamps $DSL_1$ to $DSL_6$, the paper size display lamps $PSL_1$ to $PSL_6$, and the cassette selection display lamps $CSL_1$ to $CSL_6$, that are installed on the operation panel 40.

When keys of the operation panel unit 55 are operated, the main body microcomputer 64 executes a control in accordance with the keys operations, and also a control to be described later illustrated in FIG. 1(*a*).

Meanwhile, the desk microcomputer 51 is connected with the paper size detection switch 63 corresponding to the third fixed cassette 25. Further, the lateral feed position sensor $HP_1$, the longitudinal feed position sensor $HP_2$ and a motor driver 52 are connected to the desk microcomputer 51. The motor driver 52 is connected with the cassette rotating motor 36. The motor driver 52 and the cassette rotating motor 36 are mounted independently on the first rotatable cassette unit 26 and on the second rotatable cassette unit 27.

The motor driver 52 drives the cassette rotating motor 36 to rotate clockwise or counterclockwise in response to the control signal of the desk microcomputer The desk microcomputer 51 as well as performing the communication with the main body microcomputer 64, also executes a control to be described later illustrated in FIG. 1(*b*), in response to the instruction of the main body microcomputer 64.

The first, second and third fixed cassettes 29, 28 and 25, the duplex/composite unit 21, the first and second rotatable cassette units 26 and 27, means 26*a* and 27*a* for pulling the copy paper from the above means and conveying it, the main body microcomputer 64, the desk microcomputer 51, the motor driver 52, the cassette rotating motor 36, and other means, constitute the paper feeding device 39.

Description will be made of the the control operation effectuated by the main body microcomputer 64 and the desk microcomputer 51 in the above arrangement with reference to FIG. 1(*a*) and FIG. 1(*b*).

Figure 1A:
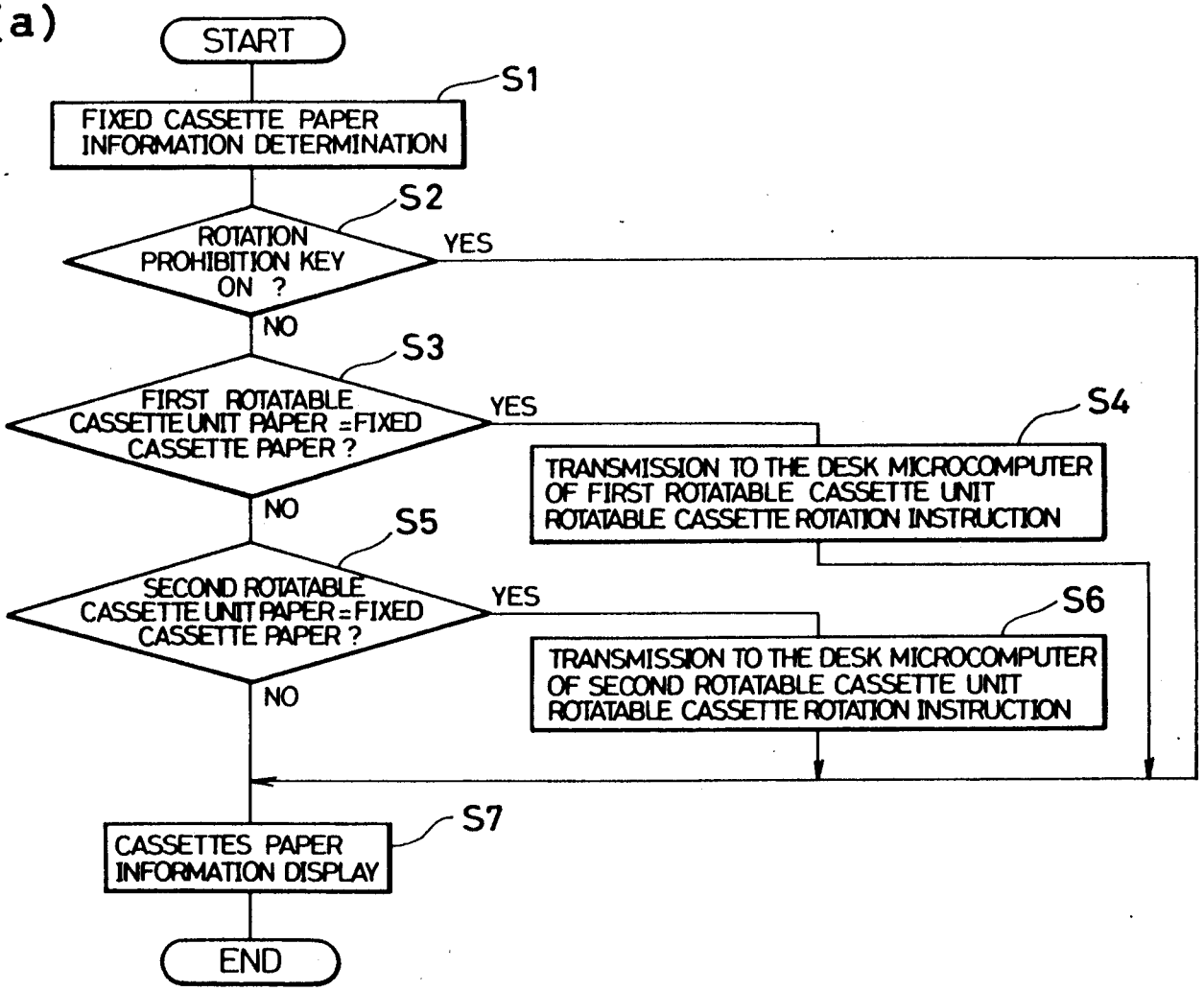
Figure 1B:
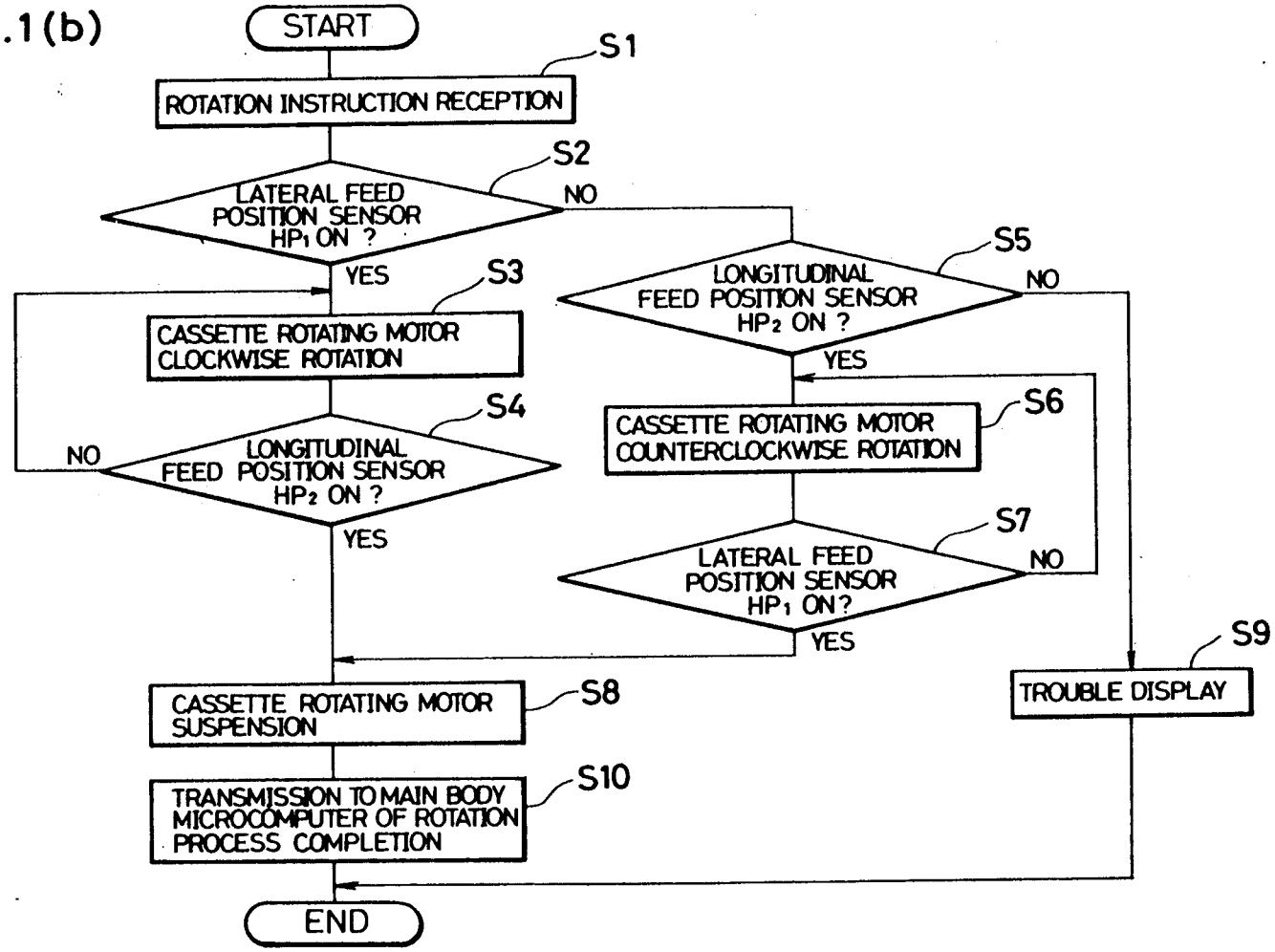

First, as illustrated in FIG. 1(*a*), when the fixed cassettes 29, 28 and 25 are mounted respectively in the corresponding cassette mounting units 62, the main body microcomputer 64 determines the information (size and feed direction) concerning the copy paper stored in the fixed cassettes 29, 28 and 25 (S1). If the rotation prohibition input key 66 is operated (S2), the information concerning the copy paper stored in the different cassettes is displayed (S7). When in S2 the rotation prohibition input key 66 is not operated, the main body microcomputer 64 determines whether or not copy paper of the same size and same feed direction is stored in the rotatable cassette 32 of the first rotatable cassette unit 26, and in one of the fixed cassettes 29, 28 and 25 (S3). If it is, the main body microcomputer 64 transmits the instruction to rotate the above rotatable cassette 32 to the desk microcomputer 51 (S4) and proceeds to S7.

If in S3, the copy paper stored in the rotatable cassette 32 of the first rotatable cassette unit 26 and the copy paper stored in any of the fixed cassette 29, 28 and 25, are not of the same size and feed direction, the main body microcomputer 64 determines whether or not copy paper of the same size and feed direction is stored in the second rotatable cassette unit 27 and in one of the fixed cassettes 29, 28 and 25 (S5) If it is, the main body microcomputer 64 transmits the instruction to rotate the above rotatable cassette 32 to the microcomputer 51 (S6), and proceeds to S7.

If in S5, the copy paper stored in the rotatable cassette 32 of the second rotatable cassette unit 27 and the copy paper stored in any of the fixed cassette 29, 28 and 25, are not of the same size and feed direction, information concerning the copy paper stored in each cassette is displayed (S7).

Meanwhile, as illustrated in FIG. 1(*b*), when it receives the instruction to rotate the rotatable cassette 32 of the first rotatable cassette unit 26 or the second rotatable cassette unit 27 (S1), the desk microcomputer 51 determines whether or not the lateral feed position sensor $HP_1$ is ON (S2). If the lateral feed position sensor $HP_1$ is ON, the desk microcomputer 51 makes the cassette rotating motor rotate clockwise (S3), and determines whether or not the longitudinal feed position sensor $HP_2$ is turned ON (S4). If the longitudinal feed position sensor $HP_2$ is turned ON, the desk microcomputer 51 stops the cassette rotating motor 36 (S8), and transmits the completion of the rotation process of the rotatable cassette 32 to the main body microcomputer 64 (S10).

In S2, when the lateral feed position sensor $HP_1$ is not ON, the desk microcomputer 51 determines whether or not the longitudinal feed position sensor $HP_2$ is ON (S5). If the longitudinal feed position sensor $HP_2$ is not ON, the occurrence of trouble is displayed (S9). If the longitudinal feed position sensor $HP_2$ is ON, the desk microcomputer 51 makes the cassette rotating motor 36 rotate counterclockwise (S6), and determines whether or not the lateral feed position sensor $HP_1$ is turned ON (S7). If the lateral feed position sensor $HP_1$ is turned ON, the desk microcomputer 51 stops the cassette rotating motor 36 (S8), and transmits the completion of the rotation process of the rotatable cassette to the main body microcomputer 64 (S10).

Figure 8:
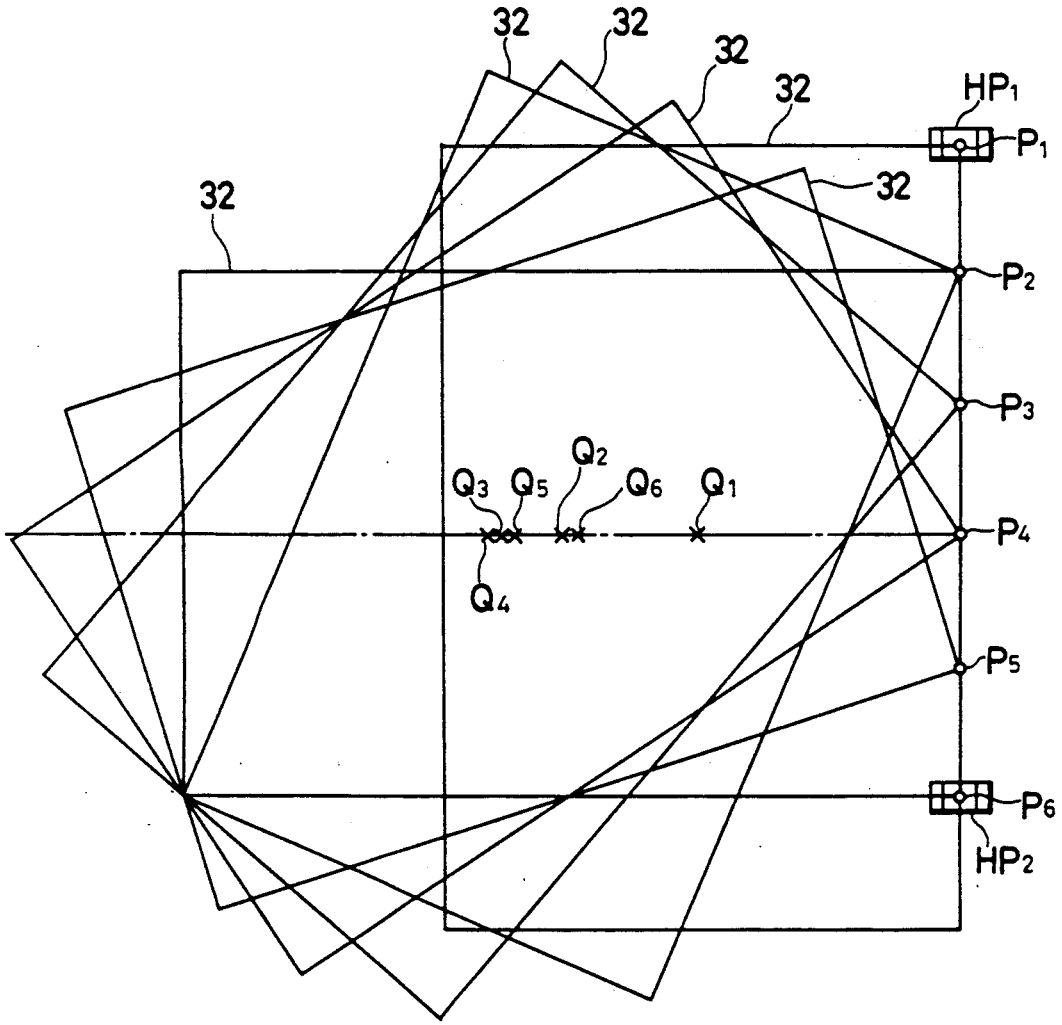

The rotation process of the rotatable cassette 32 installed in the first rotatable cassette unit 26 or in the second rotatable cassette unit 27 will be described hereinbelow with reference to FIG. 8.

As the rotatable cassette 32 pivots from the lateral feed position to the longitudinal feed position, as illustrated in FIG. 4(*a*), when the cassette rotating motor 36 rotates clockwise (in the C direction), the threaded shaft 35 rotates in the C direction. As a result, as illustrated in FIG. 8, the nut 37 moves from the position $P_1$ to the position $P_6$ following the sequence $P_1$, $P_2$, $P_3$, $P_4$, $P_5$, and $P_6$, and the guide shaft 34 of the rotatable cassette 32 rotates and moves inside the guide hole 33*a* of the cassette support plate 33, and moves back and forth from the position $Q_1$ to the position $Q_6$ following the sequence $Q_1$, $Q_2$, $Q_3$, $Q_4$, $Q_5$, and $Q_6$. When the nut 37 reaches the longitudinal feed position sensor $HP_2$, the longitudinal feed position sensor $HP_2$ turns ON indicating that the rotatable cassette 32 is placed in the predetermined longitudinal feed position.

Then, when the cassette rotating motor 36 rotates reversely from this state, the rotatable cassette 32 follows a procedure contrary to the procedure described above and pivots from the longitudinal feed position toward the lateral feed position. When the nut 37 reaches the lateral feed position sensor $HP_1$, the lateral feed position sensor $HP_1$ turns ON indicating that the rotatable cassette 32 is placed in the predetermined lateral feed position.

The copy material can be supplied to an apparatus other than a copying machine, such as for example an over-head projector. In this case, the copy material is a film.

As described above, a feeding device in accordance with the present invention comprises:

lateral feed position detecting means for detecting that a rotatable cassette is placed in a lateral feed position, longitudinal feed position detecting means for detecting that the rotatable cassette is placed in a longitudinal feed position, and control means for controlling a cassette rotating motor based on the input coming from the lateral feed position detecting means or longitudinal feed position detecting means, such that the longitudinal or lateral feed position of the rotatable cassette and the longitudinal or lateral position of a fixed cassette differ.

As a result, the situation where a rotatable cassette and a fixed cassette that contain copy paper of the same size, are placed in the same longitudinal or lateral feed position can be avoided, and the time needed for feeding the required amount of copy paper sheets in the apparatus the feeding device is attached to, may be shortened.

As described above, another feeding device in accordance with the present invention comprises in addition to the arrangement of the above feeding device, rotation prohibition input means for inputting to the control means an instruction prohibiting the rotation of the rotatable cassette, and is arranged such that the above control means cancels the control to the cassette rotating motor in response to the input from the rotation prohibition input means.

As a result, the time needed for feeding the required amount of copy paper sheets in the apparatus the feeding device is attached to, may be shortened, and in addition for example when a rotatable cassette and a fixed cassette contain copy paper of the same size and are placed on the same longitudinal or lateral feed position, a large amount of copy paper sheets may be supplied continuously when necessary.

The invention being thus described, it will be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A feeding device comprising:

at least one movable copy material orientation changing means capable of setting copy material to at least two feed positions, at least one fixed holding member having a fixed feed position in one of said feed positions, position detecting means for detecting the feed position of said copy material orientation changing means, driving means for moving said copy material orientation changing means, and control means for controlling said driving means in response to the input from said position detecting means, such that when the copy material stored in said fixed holding means and the copy material stored in said copy material orientation changing means are of the same size, the feed position of said copy material orientation changing means and the feed direction of said fixed holding means can differ.

2. The feeding device as defined in claim 1, further comprising motion prohibited input means for inputting to said control means an instruction prohibiting the motion of said control means as instruction prohibiting the motion of said copy material orientation changing means, and arranged such the said control means cancels the control to said driving means in response to the input from said motion prohibition input means.

3. A feeding device comprising:

at least one movable copy material orientation changing means capable of setting copy material to a longitudinally feed position for feeding said copy material longitudinally, or to a lateral feed position for feeding said copy material laterally, at least one fixed holding member having a fixed feed position in one of said longitudinal and lateral feed positions, driving means for moving said copy material orientation changing means, lateral feed position detecting means for detecting that said copy material orientation changing means is placed in said lateral feed position, longitudinal feed position detecting means for detecting that said copy material orientation changing means is placed in said longitudinal feed position, and control means wherein data concerning size of the copy material stored in said copy material orientation changing means, size of the copy material stored in said fixed holding member, and the longitudinal or lateral feed position of said fixed holding member is entered, and for controlling said driving means in response to the input coming from said longitudinal feed position detecting means or said lateral feed position detecting means, such that when copy material of the same size is stored in said fixed holding member and said copy material orientation changing means, the longitudinal or lateral feed position of said fixed holding member and the longitudinal or lateral feed position of said copy material orientation changing means can differ.

4. The feeding device as defined in claim 3, further comprising motion prohibition inp[illegible] means for inputting to said control means an instru[illegible]ion prohibiting the motion of the copy material orientation changing means, and arranged such that said control means cancels the control to said driving means in response to the input from said motion prohibition input means.

5. The feeding device as defined in claim 1, wherein said copy material orientation changing means comprises a guiding member mounted and projecting in a central portion of an outer face of said copy material orientation changing means, said copy material orientation changing means further comprises a rotatable cassette capable of pivoting by substantially 90° about said guiding member as central axis, the rotatable cassette being housed in a housing member and being detachable with respect to the main body of the apparatus to which said feeding device is attached.

6. The feeding device as defined in claim 1, wherein said fixed holding member is a fixed cassette detachable with respect to the main body of the apparatus to which said feeding device is attached.

7. The feeding device as defined in claims 3, wherein said driving means is a solenoid or an air piston.

8. The feeding device as defined in claim 1, wherein said copy material is copy paper for use in a copying machine or a laser printer.

9. The feeding device as defined in claim 1, wherein said copy material is a film for use in an over-head projector.

10. The feeding device as defined in claim 5, wherein said housing member comprises a supporting member that separates said copy material orientation changing means and the bottom of said housing member.

11. The feeding device as defined in claim 10, wherein said driving means is a motor capable of rotating clockwise and counterclockwise.

12. The feeding device as defined in claim 11, wherein said supporting member comprises a guide hole in a long hole shape in its central portion, and said guiding member rotates and moves back and forth inside said guide hole.

13. The feeding device as defined in claim 12, wherein:

said motor comprises a rotation shaft whereto a threaded shaft is connected, and a nut is fitted on said threaded shaft, said nut moves back and forth in the shaft direction according to the rotation of said threaded shaft.

14. The feeding device as defined in claim 13, wherein said nut comprises an upper and a lower edge, said upper edge of said nut is pivotally connected to a corner of said copy material orientation changing means, and a light interrupting member is installed on the lower edge of said nut.

15. The feeding device as defined in claim 14, wherein said position detecting means are photointerruptors that include a light emitting element and a light receiving element.

16. The feeding device as defined in claim 1, wherein said position detecting means are magnetic sensors or contact type switches.

17. The feeding device as defined in claim 1, wherein said control means comprises:

a main processing unit for determining whether the copy material stored in said copy material orientation changing means, and the copy material stored in said fixed holding member are of the same size, and if they are the same of size for releasing an instruction to move said copy material orientation changing means, and a sub-processing unit for moving said copy material orientation changing means in response to the output of said main processing unit, so that the feed position of said copy material orientation changing means and the feed position of said fixed holding member differ.

18. The feeding device as defined in claim 17, wherein said main processing unit and said sub-processing unit transmit to each other the necessary control information through a plurality of communication channels.

19. The feeding device as claimed in claim 1, wherein said fixed holding member comprises a projecting member mounted in a position in accordance with the size of the copy material stored in said fixed holding member, and arranged such that when said fixed holding member is installed in the main body of the apparatus to which said feeding device is attached, the size of the copy material stored therein is determined through said projecting member.

20. The method for moving a copy material orientation changing means installed in a feeding device comprising the steps of:

determining whether or not the copy material stored in a copy material orientation changing means and the copy material stored in a fixed holding member are of the same size, and if they are of the same size, releasing an instruction to move said copy material orientation changing means, and moving said copy material orientation changing means to the feed position in accordance with the instruction ordering the motion of said copy material orientation changing means.

21. The method as defined in claim 20, wherein said step of moving said copy material orientation changing means includes moving said copy material orientation changing means until longitudinal feed position detecting means turns ON, when lateral feed position detecting means is ON, and moving said copy material orientation changing means until said lateral feed position detecting means turns ON, when said longitudinal feed position detecting means is ON.

22. The method as defined in claim 20, wherein the motion of said copy material orientation changing means is not executed when an instruction prohibiting the motion of said copy material orientation changing means is entered through motion prohibition input means.

23. The method as defined in claim 21, wherein the occurrence of trouble is displayed when said lateral feed position detecting means and said longitudinal feed position detecting means are both OFF.

* * * * *